United States Patent [19]

Mizutani et al.

[11] Patent Number: 4,630,946

[45] Date of Patent: Dec. 23, 1986

[54] DOT PRINTER OPERABLE IN HIGH RESOLUTION AND ORDINARY PRINTING MODES

[75] Inventors: Seiki Mizutani; Mikio Hayashi; Kazuaki Ikeda, all of Tokyo, Japan

[73] Assignee: Seikosha Co., Ltd., Tokyo, Japan

[21] Appl. No.: 539,925

[22] Filed: Oct. 7, 1983

[30] Foreign Application Priority Data

Oct. 8, 1982 [JP] Japan ..... 57-177434

[51] Int. Cl.[4] ..... B41J 3/02; B41J 3/08

[52] U.S. Cl. ..... 400/121; 101/93.04

[58] Field of Search ..... 400/121, 124; 101/93.04

[56] References Cited

U.S. PATENT DOCUMENTS

| | | | |
|---|---|---|---|
| 3,764,994 | 10/1973 | Brooks et al. | 400/124 X |
| 4,010,835 | 3/1977 | Martin et al. | 400/124 |
| 4,242,003 | 12/1980 | Ragen | 400/124 |
| 4,465,386 | 8/1984 | Shimada et al. | 400/121 |

FOREIGN PATENT DOCUMENTS

| | | | |
|---|---|---|---|
| 170768 | 10/1982 | Japan | 101/93.04 |

*Primary Examiner*—Paul T. Sewell

*Attorney, Agent, or Firm*—Robert E. Burns; Emmanuel J. Lobato; Bruce L. Adams

[57] ABSTRACT

Disclosed is a printing method by using a printer of the cross hammer type, which comprises the steps of driving, in the backward travelling of a printing head, a rotary drum which is provided with a plurality of axially parallelly extending on its outer circumferential periphery, to rotate in the direction opposite to the rotational direction of the same in the forward travelling of the printing head, and driving the printing hammer such that dots are formed, in the backward travelling of the printing hammer, between dot rows formed in the forward travelling of the printing hammer so that printing is performed over one line through one reciprocating traveling of the printing head. Preferably, the printing mode is selectable between a high resolution one and an ordinary one such that in the high resolution mode, the printing head is driven in the backward travelling of the printing hammer, dots are formed between dot rows formed in the forward travelling of the printing hammer so that printing is performed over one line through one reciprocating traveling of the printing head, and in the ordinary mode, the printing hammer is driven to perform printing over one line and a new line making through each of the forward and backward travelling of the printing head.

2 Claims, 10 Drawing Figures

FIG. I

DOT PRINTER OPERABLE IN HIGH RESOLUTION AND ORDINARY PRINTING MODES

BACKGROUND OF THE INVENTION

1. Field of the Invention

The present invention relates to a printing method for a dot printer in which printing is performed while causing a printing head to move in a direction perpendicular to the feeding direction of a recording medium.

2. Description of the Prior Art

Conventionally, in order to improve the resolution (increase the density of dots) in a dot printer for forming characters or the like with a dot matrix, the following device has been proposed. That is, generally, a method is used in which printing elements such as printing wires, printing electrodes, or the like, are arranged in two columns in a staggered or zigzaged relation. This method, however, is disadvantageous due to the complexity in construction, the increase in the number of constituent components, the increase in the size of the printing head, the increase in the cost of production, etc. In this respect, another method has been proposed in which high resolution printing is performed with a longitudinally arranged single columnsrow of printing elements as conventionally used. In this method, one of a recording medium and a printing head is moved relative to the other by a half pitch in the direction of a column (longitudinal direction) to thereby form dots also in the intermediate portion. This method, however, has a disadvantage that the actual printing speed is reduced by the fact that the operation to accurately move the recording medium or the printing head in the direction of the column by a half pitch is inserted in the midway of one line printing operation.

SUMMARY OF THE INVENTION

An object of the present invention is therefore to eliminate the aforementioned disadvantages in the prior art printing methods.

Another object of the present invention is to provide a printing method with a printer which is suitable to perform high resolution printing by using a dot printer of the cross hammer type without effecting relative movement in the direction of a column between a printing head and a recording medium.

To this end, according to the present invention, a printing method is provided which is preferably to perform printing with high resolution by using a dot printer of the cross hammer type which is provided with a rotary drum having a plurality of parallel protrusions axially extending on its outer circumferential periphery, and a printing head adapted to be moved by the front of the rotary drum in the direction perpendicular to the feeding direction of a recording medium, the printing head being provided with a printing hammer substantially intersectionally faced to the protrusions of the rotary drum so that the printing hammer is selectively driven to run onto the protrusion to thereby form characters or the like on the recording medium. According to the printing method of the present invention, the high resolution printing can be performed without effecting the relative movement in the direction of a column between the printing head and the recording medium.

The above and further objects and novel features of the invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

The drawings illustrate an embodiment of the present invention, wherein.

PREFERRED EMBODIMENTS OF THE INVENTION

Figure 1:
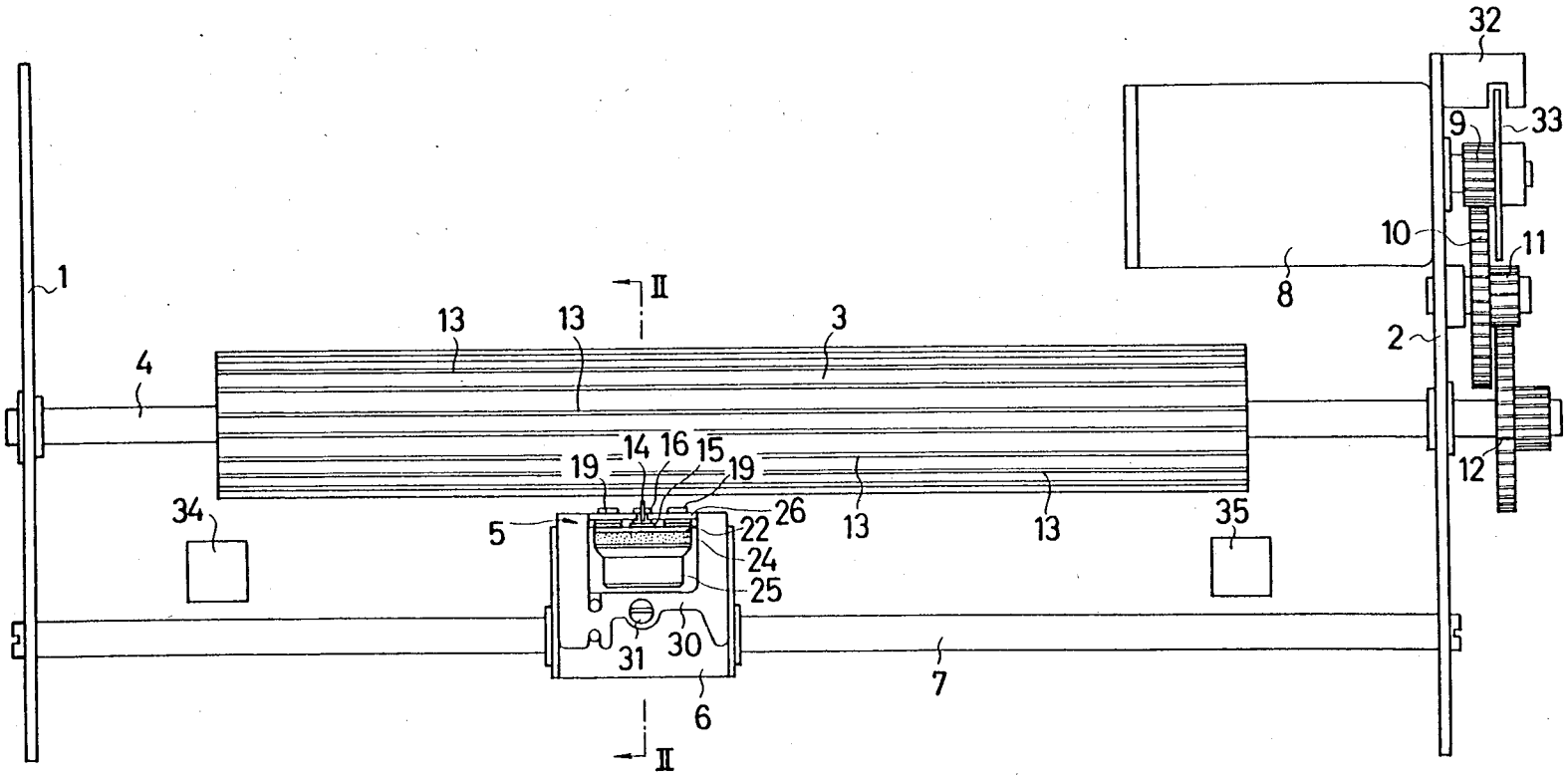
FIG. 1 is a plan view of a dot printer of the cross hammer type.

Referring to the drawings a preferred embodiment of the invention will be described hereunder. In FIG. 1, side plates 1 and 2 are disposed in parallel with each other with a predetermined space therebetween, and a rotary shaft 4 fixed to a rotary drum 3 is rotatably supported by the side plates 1 and 2. A printing head 5 faces the rotary drum 3 and is mounted on a carriage 6 which is in turn slidably supported by two guide shafts 7 (see FIG. 2) fixed to the side plates 2 and 3. A drive motor 8 is mounted on the side plate 2 and the rotation of the drive motor 8 is transmitted to a gear 12 through a motor pinion 9, a gear 10 and a pinion 11 integrally formed with the gear 10. The gear 12 is fixedly attached to an end portion of the rotary shaft 4 extending rightward through the side plate 2 so that the rotary drum 3 can be driven to rotate by the motor 8.

Figure 2:
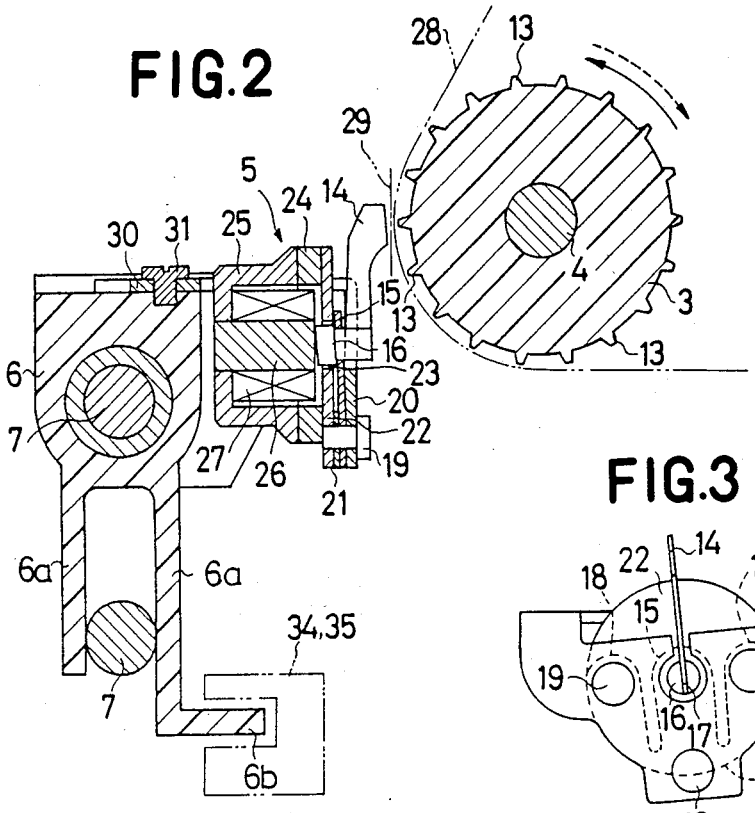
FIG. 2 is an enlarged cross-section along II—II line in FIG. 1.
Figure 3:
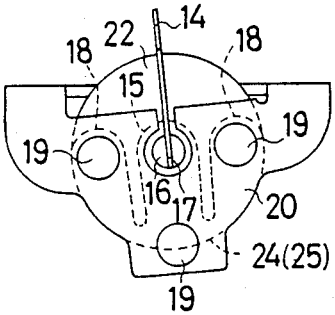
FIG. 3 is an enlarged front view of a printer head.
Figure 4:
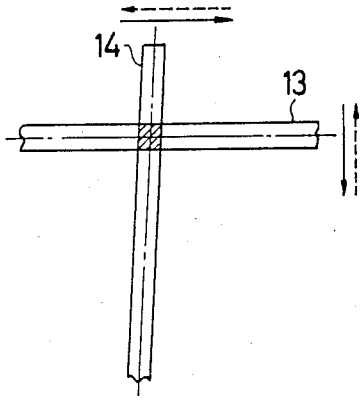
FIG. 4 is a diagram showing the relation of intersection between the protrusions of a rotary drum and the printing hammer of a printing head.

As apparent from FIG. 2, the rotary drum 3 is integrally equidistantly provided at its outer circumferential surface with a plurality of protrusions 13 each extending in the axial direction of the drum 3. The printing head 5 is disposed such that, as shown in FIGS. 2 and 3, a printing hammer 14 may be brought into striking engagement with the protrusions 13 so as to intersect the same at an inclination of a predetermined angle. The lower end portion of the printing hammer 14 is inserted in a split groove 17 of a movable yoke 16 fixed to a free end of a plate spring 15. The plate spring 15 is integrally provided with tongue portions 18 extending from the opposite sides of the base portion (lower end portion) of the plate spring 15. The tongue portions 18 and the base portion are fixedly attached to the rear surface of a supporting plate 20 respectively through pins 19. A front yoke 22 is fixedly attached with the pins 19 to the rear surface of the plate spring 15 through a spacer 21. The front yoke 22 is circularly shaped and has, at its center, a center hole 23 through which extends the rear portion of the movable yoke. An annular plate-like permanent magnet piece 24 is fixedly attached onto the rear surface of the front yoke 22 and a cylindrical cap-like rear yoke 25 is fixedly attached onto the rear surface of the permanent magnetic piece 24. A center yoke 26 is forwardly fixed at the center of the bottom of the rear yoke 25 so that the movable yoke 16 is magnetically attracted by the magnetic flux toward the front end surface of the center yoke 26 against the spring force of the plate spring 15, thereby retaining the printing hammer 14 at a position retracted from the protrusion 13 of the drum 3. A coil 27 is wound about the center yoke 26. In response to energization of the coil 27, the magnetic flux of the permanent magnet piece 24 can be cancelled so that the magnetic attraction of the movable yoke 16 toward the center yoke 26 is released. Accordingly, the backward bias of the plate spring 15 is released so that the printing hammer 14 is urged forwardly by the spring force of the plate spring 15 and strikes against the protrusion 13 of the rotary drum 3. A recording medium 28 and an ink ribbon 29 are inserted between the printing hammer 14 as shown in FIG. 2 and the protrusion 13 of the rotary drum 3 so that dots are formed by the collision between the printing hammer 14 and the protrusion 13 of the drum 3 at the position of the collision (intersection). A lateral plate portion 30 of the supporting plate 20 is fixed by a screw 31 to the carriage 6.

The direction of rotation of the rotary drum 3 is changed over between counterclockwise and clockwise directions by changing the rotational direction of the motor 8 of FIG. 1. When the rotary drum 3 is rotationally driven in the counterclockwise direction in FIG. 2, the printing head 5 is moved from left to right in FIG. 1, while when the rotary drum 3 is rotationally driven in the clockwise direction FIG. 2, the printing head 5 is moved from right to left in FIG. 1. The movement of the printing head 5, that is, the movement of the carriage 6, is performed through a spacing mechanism (not shown) and the speed of movement is correlated with the rotational speed of the rotary drum 3. Although the protrusion 13 of the rotary drum 3 and the printing hammer 14 of the printing head 5 intersect with each other, when the printing head 5 travels forward, the printing hammer 14 moves from left to right and at the same time the protrusion 13 moves downward relative to the printing hammer 14. Although such movements of the printing hammer 14 and the protrusion 13 are effected simultaneously and continuously, the intersectional position therebetween registers on the predetermined matrix because the printing hammer 14 is slanted by a predetermined angle relative to the protrusions 13. While one of the protrusions 13 passes by the front of the printing hammer 14, the printing hammer 14 is selectively driven to form one row of a dot matrix. The same procedure is repeated in the following passes so that the row of the dot matrix is formed successively one by one every time one protrusion 13 passes by the front of the printing hammer 14.

Figure 10:
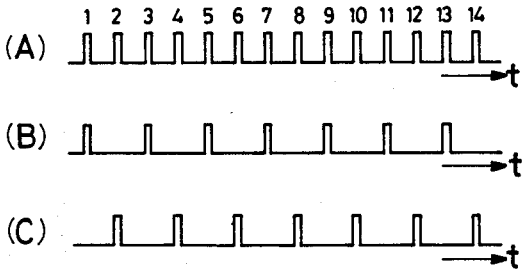
FIG. 10 is a time chart in which (A) shows a detecting signal of the dot sensor, and (B) and (C) respectively show printing timing signals.

The intersecting position of the protrusion 13 relative to the printing hammer 14 is detected by a dot sensor 32. A slit disc 33 having numbers of small holes (not shown) circumferentially formed at its outer periphry is integrally formed with the motor pinion 9 and disposed such that the outer periphery of the slit disc 33 is inserted into the recessed portion of the dot sensor 32. As well known, the dot sensor 32 contains therein a light emission element and a light receiving element (both not shown). While one of the protrusions 13 passes by the front of the printing hammer 14, the dot sensor 32 produces a detection signal as shown in FIG. 10(A). The detection signal of FIG. 10(A) is produced while the printing head 5 travels forward, that is, when the rotary drum 3 rotates counterclockwise in FIG. 2, and the sensor 32 is arranged such that the 1st, the 2nd, . . . , the 14th pulse of the detection signal are generated when the protrusion 13 exists at the positions corresponding to the 1st, the 2nd, . . . , the 14th row of the dot matrix. While the printing head 5 travels backward, that is when the rotary drum 3 rotates clockwise in FIG. 2, the detection signal of the dot sensor 32 is quite the same in appearance as that of FIG. 10(A), but the respective pulses of the signal are produced in the order opposite to that in FIG. 10(A). Thus, in the backward travelling of the printing head 5, the 1st pulse is generated when the protrusion 13 exists at the 14th row of the dot matrix.

In FIG. 1, a left home sensor 34 and a right home sensor 35 are provided so as to detect in which one of the left and right home positions the printing head 5 exists. Each of the home sensors 34 and 35 is arranged similar to the dot sensor 32 such that a shielding plate **6*b* integrally provided with and extending from one of the opposite legs 6*a* and 6*a* at the lower portion of the carriage 6 is able to enter the respective recessed portions of the home sensors 34 and 35 as shown in FIG. 2** when the printing head reaches the home positions.

Next, the printing method according to the present invention applied to a dot printer of the cross hammer type as described above will be described hereunder.

Figure 5:
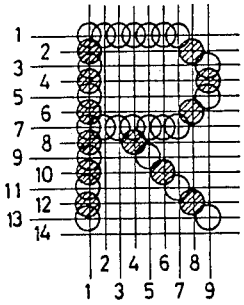
FIG. 5 is an enlarged diagram showing an example of printing in the high resolution printing mode.
Figure 6:
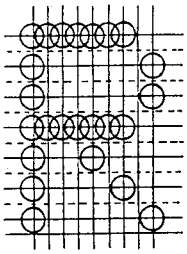
FIG. 6 is an enlarged diagram showing an example of printing in the ordinary printing mode.

Prior to the detailed description, the printing method will be described briefly. In the method, the printing mode can be changed over between a high resolution printing mode and an ordinary printing mode. In the high resolution printing mode, the printing of one line is performed with high resolution by one reciprocation of the printing head 5 (FIG. 5), while in the ordinary printing mode, the printing of one line is performed with ordinary resolution by each of the forward and backward travellings of the printing head 5 (FIG. 6). In FIG. 5, ○ and ● represent dots formed in the forward and backward travellings of the printing head 5 respectively.

Figure 7:
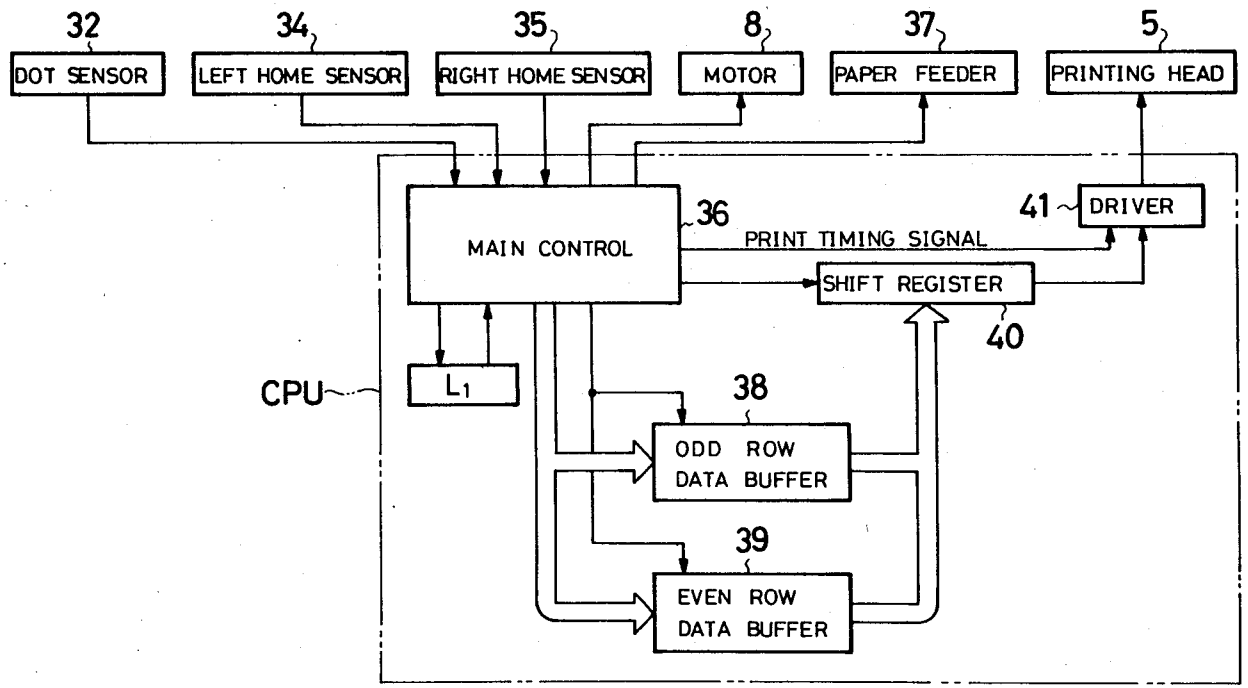
FIG. 7 is a block diagram illustrating a control circuit of the printer.
Figure 8:
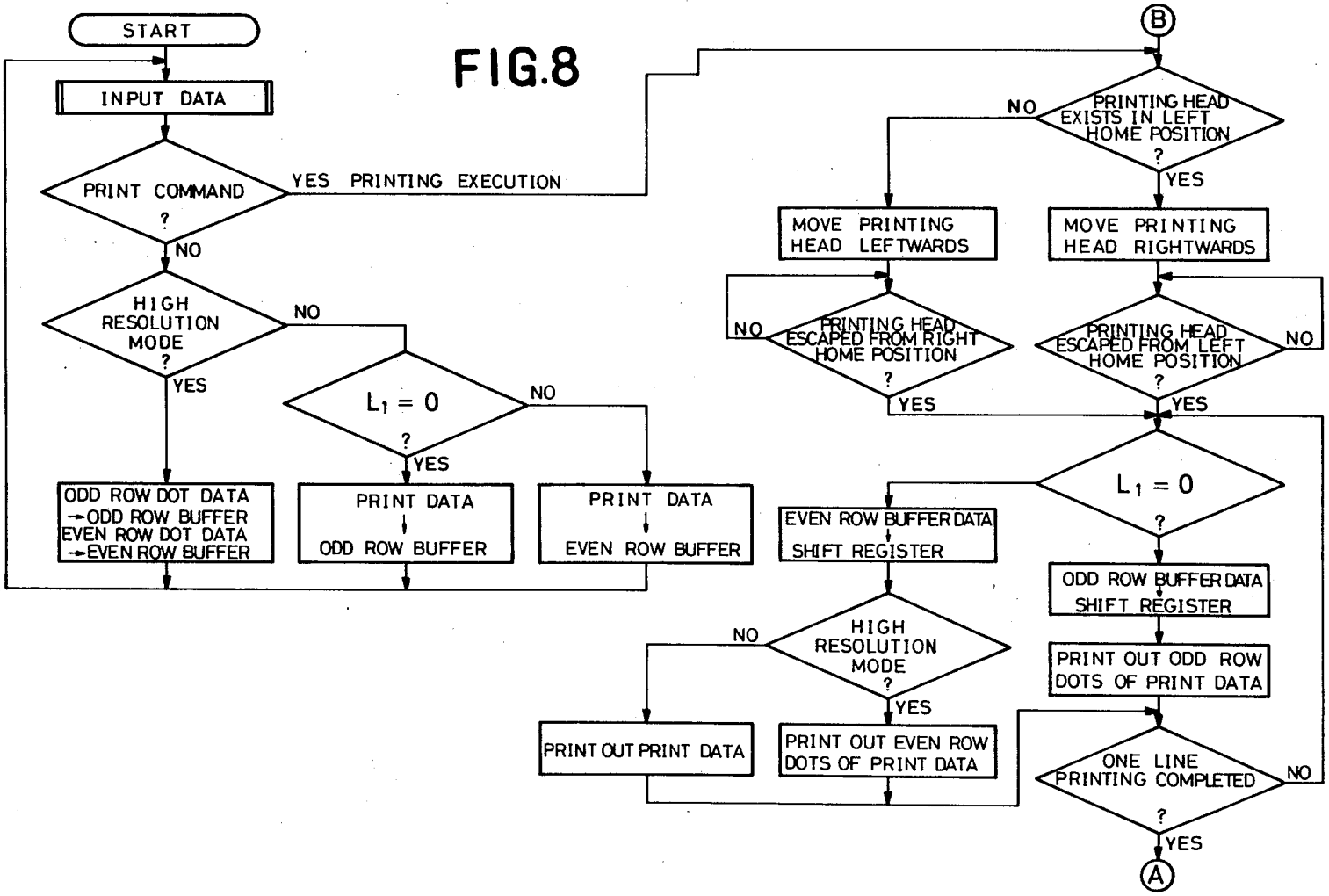
FIGS. 8 and 9 are flowcharts showing the printing operations.
Figure 9:
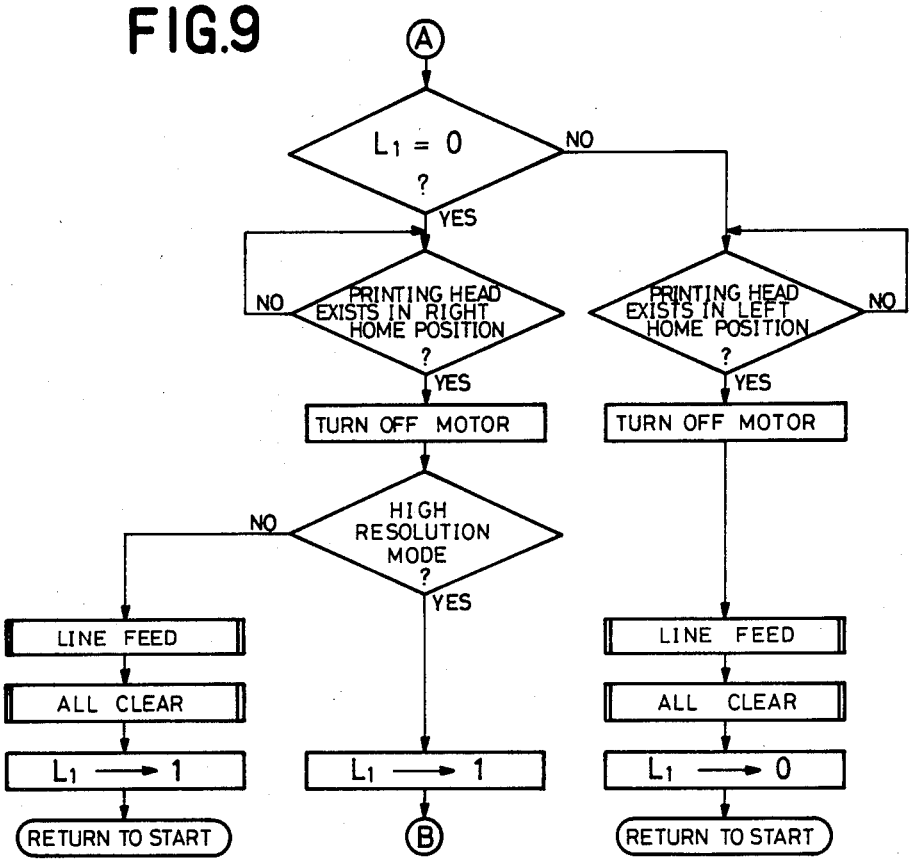

In FIG. 7, the reference numeral 36 denotes a control section of a central processing unit CPU which receives the signals from the dot sensor 32 and the home sensors 34 and 35 so as to control the printing head 5, the motor 8, a paper feeding dvice 37, data buffers 38 and 39, a shift register 40, and a driver 41 in accordance with the flowchart of FIG. 8. A means $L_1$ for judging whether the printing head 5 is travelling in the forward or the backward direction is constituted, for example, by a flip-flop so as to produce a "0" and "1" output in the forward and backward travellings of the printing head 5 respectively.

The detection signal (FIG. 10(A)) of the dot sensor 32 is not used as it is for effecting the printing timing. The control section 36 receives the detection signal of the dot sensor 32 and produces the printing timing signal of FIG. 10(B) or (C) depending on whether the travelling of the printing head 5 is in the forward or backward direction and whether the printing mode is in the high resolution or ordinary mode. In the high resolution printing mode, the control section 36 produces the signal of FIG. 10(B) in each of the forward and backward travellings. It should be noted here that the printing timing signal of FIG. 10(B) in the forward travelling corresponds to an odd-numbered row of the dot matrix, while the printing timing signal of FIG. 10(B) in the backward travelling corresponds to an even-numbered row of the dot matrix (see FIG. 5). In the ordinary printing mode, on the other hand, the control section 36 produces the timing signal of FIG. 10(B) in the forward travelling, while produces the timing signal of FIG. 10(C) in the backward travelling. It should be noted here that each of the timing signal of FIG. 10(B) in the forward travelling and the timing signal of FIG. 10(C) in the backward travelling corresponds to an odd-numbered row of the dot matrix of FIG. 5.

Assume that the printing head 5 is at the left home position and all the means $L_1$, etc. are cleared in the initial state.

The printing operation in the high resolution mode will be described. First, when a data to be printed is inputted from an external equipment, the data is separated into the data so as to the dots of odd-numbered rows to be stored in the odd row data buffer 38 and the data as to the dots of even-numbered rows to be stored in the even row data buffer 39. Then, upon the reception of a printing command signal, the rotary drum 3 is driven counterclockwise in FIG. 2 by the motor 8 and at the same time the printing head 5 begins to move rightward in FIG. 1. When the left home sensor 34 detects the departure of the printing head 5 from the left home position, the data stored in the odd row data buffer 38 is written into the shift register 40. Because of being in the high resolution mode and in the forward travelling ($L_1=0$), the control section 36 produces the printing timing signal of FIG. 10(B) so that the data in the shift register 40 is printed out in synchronism with this printing timing signal. Since this printing timing signal corresponds to the odd-numbered rows of dot matrix, dots are printed at the odd-numbered rows as indicated by ○ in FIG. 5. If the arrival of the printing head 5 at the right home position is detected by the right home sensor 35 upon the completion of printing of one line, the motor 8 is stopped and the means $L_1$ is set to "1".

Upon the restart of the motor 8 thereafter, the motor 8 is driven in the direction opposite to the direction in the forward travelling so that the rotary drum 3 rotates clockwise (in the direction indicated by broken line arrow) in FIG. 2. At the same time, the printing head 5 is moved leftward in FIG. 1 from the right home position. When the right home sensor 35 detects the departure of the printing head 5 from the right home position, the data stored in the even row data buffer 39 is written into the shift register 40, since $L_1=1$ now. As described above, since the dot sensor 32 produces in the backward travelling its output pulses in the order opposite to the case of FIG. 10(A), the printing timing signal in the backward travelling (the same as that of FIG. 10(B)) actually corresponds to the even-numbered pulses of the signal of FIG. 10(A) and corresponds to the even-numbered rows in the dot matrix.

Accordingly, when the printing head 5 travels backward, the data in the even row data buffer 39 is formed in the even-numbered rows, for example, as shown in FIG. 5. That is, the dots ● of the backward travelling are inserted between the rows of dots ○ formed in the forward travelling. Thus, printing is performed with high resolution for one line by one reciprocation of the printing head 5 and when the printing head 5 comes back to the left home position, the motor 8 is stopped. At that time, a new line on the recording medium 28 is selected by advancement of the recording medium by the paper feeding device 37 of FIG. 7 and the means $L_1$ is cleared to "0". The same operation is repeated then again.

In the ordinary printing mode, one line of printing (FIG. 6) and a new line making are performed in each of forward and backward travellings of the printing head 5. The printing operation in the forward travelling of the printing head 5 is substantially the same as that in the forward travelling in the high resolution mode. When the printing head 5 travels backward, printing is performed in synchronism with the printing timing signal of FIG. 10(C) to form dots on the odd-numbered rows in FIG. 5 in the same manner as the forward travelling.

In the embodiment as described above, the number of the pulses of the detection signal of FIG. 10(A) corresponding to one column can be desiredly set in accordance with the construction of the matrix. It is noted that when the number of these pulses is an odd number, the timing signals of FIGS. 10(B) and (C) are used in the forward and backward travellings respectively in the high resolution mode, and the timing signal of FIG. 10(C) is used in each of the forward and backward travelling in the ordinary mode.

According to the printing method of the present invention, one line of printing is performed by one reciprocation of the printing head with high resolution and the desired printing can be made with accuracy at high speed due to the relative movement in the column direction between the printing head the recording medium during the printing. Further, if necessary, the ordinary printing mode can be selected.

What is claimed is:

1. In a dot printer which is provided with a rotary drum having a plurality of parallel protrusions axially extending therealong on its outer circumferential periphery and a printing head movable back and forth in front of said rotary drum in directions perpendicular to the feeding direction of a recording medium, said printing head carrying a printing hammer mounted so as to face said protrusions of the rotary drum so that said printing hammer can be selectively driven to strike against respective ones of said protrusions to thereby form characters or the like on the recording medium, a printing method comprising the steps of:

driving said rotary drum, during the backward travelling of said printing head, to rotate in a direction of rotation opposite to the rotational direction of the rotary drum during the forward travelling of said printing head; and driving said printing hammer such that dots are formed on the recording medium during the backward travelling of said printing hammer between dot rows formed during the forward travelling of said printing hammer so that printing is performed over one line through one reciprocating travelling of said printing head without advancing the recording medium throughout the printing of said one line.

2. In a dot printer which is provided with a rotary drum having a plurality of parallel protrusions axially extending therealong on its outer circumferential periphery and a printing head movable back and forth in front of said rotary drum in directions perpendicular to the feeding direction of a recording medium, said printing head carrying a printing hammer mounted so as to face said protrusions of the rotary drum so that said printing hammer can be selectively driven to strike against respective ones of said protrusions to thereby form characters or the like on the recording medium, a printing method comprising the steps of:

driving said rotary drum, during the backward travelling of said printing head, to rotate in a direction of rotation opposite to the rotational direction of the rotary drum during the forward travelling of said printing head such that the printing mode is selectable between a high resolution printing mode and an ordinary printing mode;

driving said printing hammer, in said high resolution printing mode, such that during the backward travelling of said printing hammer, dots are formed on the recording medium between dot rows formed during the forward travelling of said printing hammer so that printing is performed over one line through one reciprocating travelling of said printing head without advancing the recording medium throughout the printing of said one line; and driving said printing hammer, in said ordinary printing mode, such that printing is performed on the recording medium over one line through each of the forward and backward travelling of said printing head.

* * * * *